US007866461B2

(12) United States Patent
Vigano' et al.

(10) Patent No.: US 7,866,461 B2
(45) Date of Patent: Jan. 11, 2011

(54) ROLLER ACTUATING DEVICE FOR MACHINES USED FOR PROCESSING METAL PRODUCTS

(75) Inventors: Claudio Vigano', Cividale Del Friuli (IT); Lucá Sandrin, Terzo Di Aquileia (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 287 days.

(21) Appl. No.: 11/996,353

(22) PCT Filed: Jul. 20, 2006

(86) PCT No.: PCT/EP2006/064454

§ 371 (c)(1),
(2), (4) Date: Sep. 25, 2008

(87) PCT Pub. No.: WO2007/010021

PCT Pub. Date: Jan. 25, 2007

(65) Prior Publication Data

US 2010/0018840 A1 Jan. 28, 2010

(30) Foreign Application Priority Data

Jul. 22, 2005 (IT) ..... MI2005A1413

(51) Int. Cl.
*B65G 13/06* (2006.01)

(52) U.S. Cl. ..... 198/791; 198/788; 72/249

(58) Field of Classification Search ..... 198/781.07, 198/788, 791; 72/249
See application file for complete search history.

(56) References Cited

U.S. PATENT DOCUMENTS

| | | | | | |
|---|---|---|---|---|---|
| 2,959,077 | A | * | 11/1960 | Heym | 72/100 |
| 3,495,467 | A | * | 2/1970 | Herbay et al. | 74/128 |
| 3,580,036 | A | * | 5/1971 | Zayats et al. | 72/249 |
| 3,850,213 | A | * | 11/1974 | Keaton | 100/154 |
| 3,981,171 | A | * | 9/1976 | Kmelisch | 72/249 |
| 4,056,957 | A | * | 11/1977 | Howard | 72/14.4 |
| 4,103,565 | A | * | 8/1978 | Matikainen et al. | 74/665 L |
| 4,131,420 | A | * | 12/1978 | Miller | 432/246 |
| 4,182,205 | A | * | 1/1980 | Baker | 82/121 |
| 4,313,536 | A | * | 2/1982 | Fauth | 198/781.02 |
| 4,718,843 | A | * | 1/1988 | Carlsson et al. | 425/371 |
| 4,828,103 | A | * | 5/1989 | Fauth, Sr. | 198/781.06 |

(Continued)

FOREIGN PATENT DOCUMENTS

DE 3501871 7/1986

(Continued)

*Primary Examiner*—Joe Dillon, Jr.
(74) *Attorney, Agent, or Firm*—Gifford, Krass, Sprinkle, Anderson & Citkowski, P.C.

(57) ABSTRACT

Roller actuating device for flattening machines used for metal products in the shape of sheet metal, strips or the like, also used with similar machines for other applications, comprising a device for transmitting motion to driven rolls (8), extremely functional and capable of transmitting higher torques as well as their independent control. Such device overcomes the frequent problems concerning the space available for installing gimbal adapters. This can be achieved by using adapters (4) provided with teeth which, with the same flange diameter, are able to provide higher torques, and in any case, can be used in any applications in which it is necessary to have reduced operating angles of the adapters.

7 Claims, 6 Drawing Sheets

U.S. PATENT DOCUMENTS 4,836,358 A * 6/1989 Fauth et al. ..... 198/789
4,903,518 A * 2/1990 Kimura et al. ..... 72/249
5,011,004 A * 4/1991 D'Amato ..... 198/791
5,127,250 A * 7/1992 Nagata ..... 72/165
5,129,250 A * 7/1992 Palma et al. ..... 72/234
5,325,697 A * 7/1994 Shore et al. ..... 72/234
5,375,696 A * 12/1994 Collins et al. ..... 198/781.04
5,412,968 A * 5/1995 Benz ..... 72/164
5,934,130 A * 8/1999 Kajiwara et al. ..... 72/249
7,014,037 B2 * 3/2006 Groitl ..... 198/781.07

FOREIGN PATENT DOCUMENTS

EP 1016472 7/2000
JP 62240113 10/1987
JP 63068223 3/1988

* cited by examiner

SEC. B-B

ROLLER ACTUATING DEVICE FOR MACHINES USED FOR PROCESSING METAL PRODUCTS

FIELD OF INVENTION

The present invention relates to a roller actuating device for machines—in particular, for flattening machines known as "levelers"—used for processing metal products such as sheet metal, strips or other similar metal products, comprising devices for transmitting motion to the operating rollers. This device can be used for any application in which the pitch between the driven rollers is so reduced that it may affect the use of articulated transmission members.

STATE OF THE ART

Different devices for operating the rollers of machines used for processing metal products are known, mainly flattening machines or "levelers".

A first embodiment of a roller actuating mechanism of a flattening machine is described in the document DE3501871 in which the flattening rollers are supported by supporting rollers, each of which is individually controlled by its motor by means of its own gear unit. The flattening rollers or supporting rollers are connected with cardan shafts to their own gear unit. This unit is offset laterally, and is inserted and driven alternately on the opposite sides by its fixed electric motor.

Other roller actuating systems of a flattening machine are described in the documents JP62240113 and JP63068223; they include methods for improving the flattening or straightening effect of a strip or metal sheet passing through the top and bottom rollers of the machine.

In the first document, JP62240113, the improvement of the process is achieved by applying an additional tractive force to the strip through a reduction of the operating speed of the first flattening rollers as well as an acceleration of the succeeding rollers.

Instead, the second document, JP63068223, describes a roller flattening machine which features gearboxes, along the run of the strip, supporting each flattening roller. These gearboxes include loadmeters which enable the machine to give the correct tension to the strip, thereby preventing slippage between the flattening rollers and the strip itself.

However, all these devices or roller actuating systems have various disadvantages, which basically:

- do not allow the transmission of high torque values because of the use of cardan shafts, such as gimbal adapters;
- include considerable overall dimensions, especially where the motion transmission gears are located, particularly the motors, which are quite large;
- involve major maintenance difficulties in case the inspection and removal of some components (e.g. adapters or internal gears of the reduction unit) is required.

Therefore, it has been considered necessary to design a roller actuating device for processing metal products capable of dealing with the aforesaid drawbacks.

SUMMARY OF THE INVENTION

An objective of the present invention is to achieve an innovative roller actuating device for machines—e.g. flattening machines used for processing strips or sheet metal, or other similar products—extremely functional and capable of transmitting higher torques.

Another objective is to provide a much more compact roller actuating device than the one used in other known devices, thereby considerably reducing the space occupied by the whole machine throughout the whole production line and, at the same time, minimizing implementation costs.

Therefore, the present invention intends to achieve the above-mentioned objectives by means of a roller actuating device for machines used for processing metal products, said rollers being capable of rotating and defining their axes of rotation, which comprises, in accordance with claim 1, motor devices for transmitting rotation to said rollers, devices for transmitting motion from said motor devices to said rollers, wherein the transmission devices include, for each roller, a first pinion reduction gear unit and a sprocket, a second sun-and-planet motion gear reduction unit, a flat gear distribution which connects said second reduction gear unit to a transmission shaft for transmitting rotation to the roller.

Advantageously, the roller actuating device shall require an independent motor drive for each roller (see following components):

- an electric motor;
- a reduction gear with a train of crown wheels
- a three—or more—gear distribution, with one or more spacer idle wheels;
- a toothed adapter.

All distributions with three or more gears, one for each roller, make up the distributor.

This solution makes it possible to transmit high torque values by using the toothed adapters between the distributor and the rollers, said adapters being much more compact than the gimbal adapters, and to have a compact transmission system by using planetary reduction gears instead of large flat reduction gears in case considerable reduction ratios are required. If small reduction ratios are required, it is possible, as an alternative, to use flat reduction gears.

The device advantageously includes a finger arrangement of the distributor gears which makes it possible to optimize the spaces and move the shaft motion output axes closer in order to reduce the operating angles of the toothed adapters, preferably between 0 and 2°.

The number of operating rollers, hence the number of motors and reduction gears, can vary from 3 to a value of "n", said value being compatible with the available spaces.

The dependent claims describe preferred embodiments of the invention.

BRIEF DESCRIPTION OF THE FIGURES

Further features and advantages of the invention will become apparent from the detailed description of a preferred, but not exclusive, merely illustrative and not limitative embodiment of a roller actuating device for machines used for processing metal products, with the aid of the attached drawings wherein.

DETAILED DESCRIPTION OF A PREFERRED EMBODIMENT OF THE INVENTION

Figure 1:
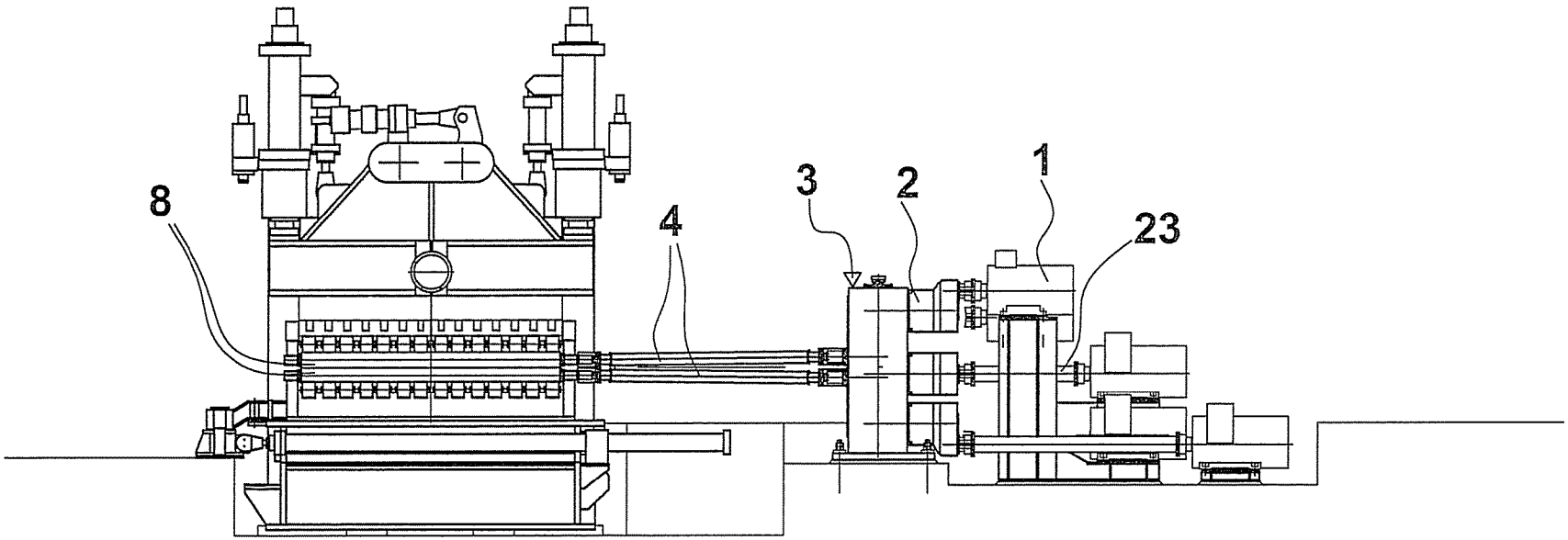
FIG. 1 shows a side view of a flattening machine comprising a device according to the invention.
Figure 2:
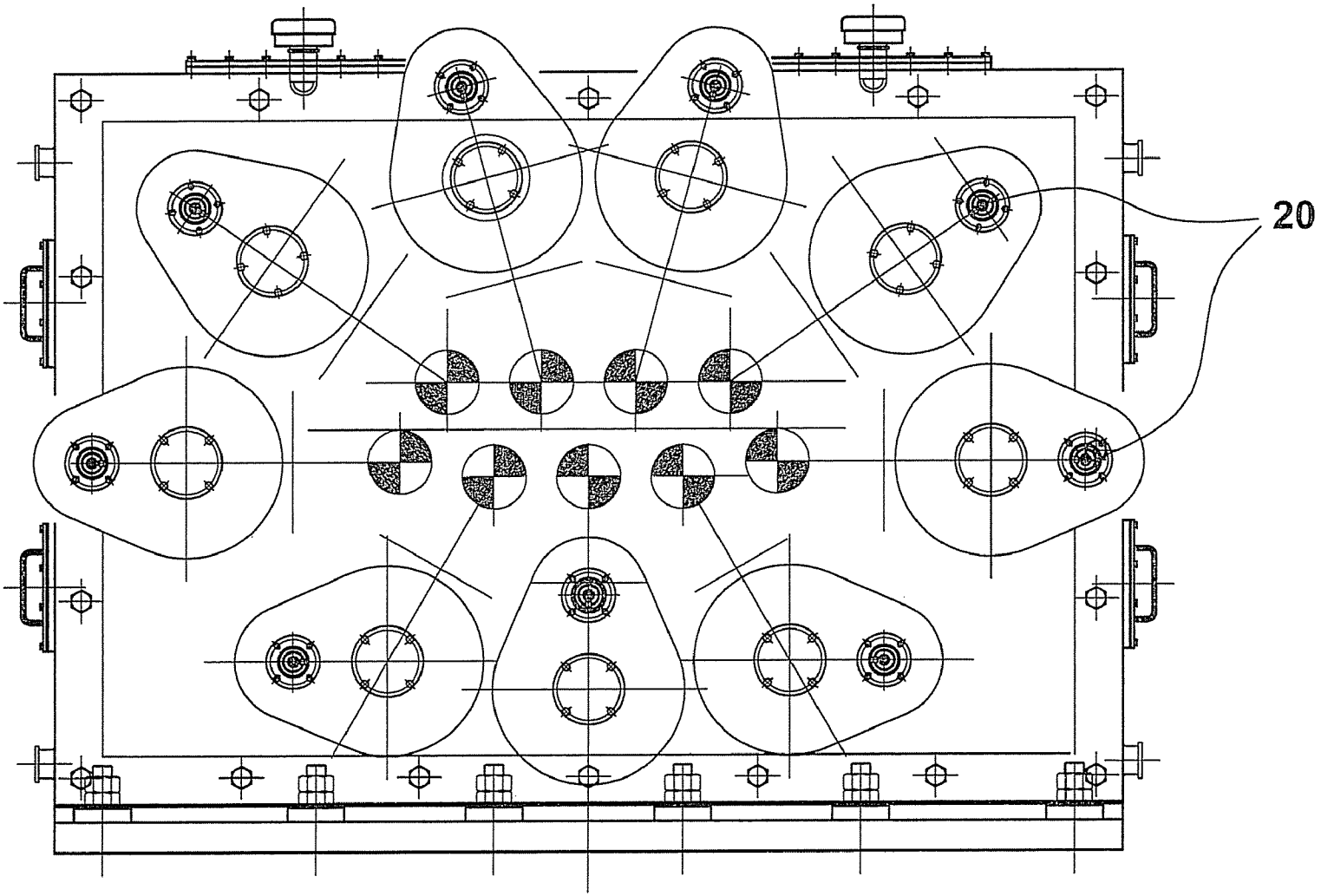
FIG. 2 shows a front view of a first component of the device according to the invention

The Figures show a roller actuating device 8 of a flattening machine used for processing strips or other similar metal products. Each roller 8, called flattening roller, is individually operated by means of the following components:

an electric motor 1;

a reduction gear 2 with a train of crown wheels with cylindrical pre-reduction;

a three gear distribution 3', with a center spacer idle wheel 12;

a toothed adapter 4.

All distributions 3' with three or more gears, one for each roller 8, make up the distributor 3.

A toothed gear mating with, for instance, the pinion 21 and the sprocket 22, which make up a first reduction gear unit, shall be required between the reduction gears 2 with a train of crown wheels and their corresponding motors 1. Each pinion 21 is integral with an input shaft 20 directly connected to its motor.

Since in this zone there are low torque values, it could be possible to use either gimbal adapters or toothed joints 23 to connect the motors to the corresponding reduction gear unit 2.

Advantageously, the motors 1 are set on one side relative to the box containing the gear distributions 3' which also supports the planetary reduction gears 2.

Said frame, along with the distributions 3' contained therein, makes up the distributor 3.

Other connections, for instance toothed connections or a fitted shaft, are required between said reduction gears 2 with a train of distribution gears 3.'

In a preferred embodiment of the invention, the actuating device of the flattening rollers 8 includes nine reduction gears 2 with a train of crown wheels used for achieving the required reduction, yet maintaining the independence between the driven flattening rollers.

Advantageously, a planetary configuration allows for an extreme compactness and achievement of a high reduction of speed.

Planetary reduction gears 2 also include the following features:

one-stage arrangement with integral pre-reduction;

a steel box or "case" connected to the distributor body 3 with a series of bolts or other fixing elements, both boxes making up a support frame set onto the foundations;

casehardened steel gears and pinions;

helical teeth for sprockets and pinions;

antifriction bearings.

Instead, the gear distributor 3 advantageously includes an arrangement with nine input shafts 5 and nine output shafts 6 to support and connect each planetary reduction gear 2 with its corresponding toothed adapter 4, hence with the driven flattening roller 8. Each roller includes a three—or more—gear distribution 3' in the distributor 3, which comprises at least one driving pinion 11 on an input shaft 5 connected to a reduction gear 2, at least one idle wheel 12 on an intermediate shaft to transfer the torque and at least one driven pinion 13 on an output shaft 6 connected to its corresponding toothed adapter 4. An equal number of helical toothed elements is generally fitted onto the corresponding shafts so as to compensate the thrusts.

Figure 3:
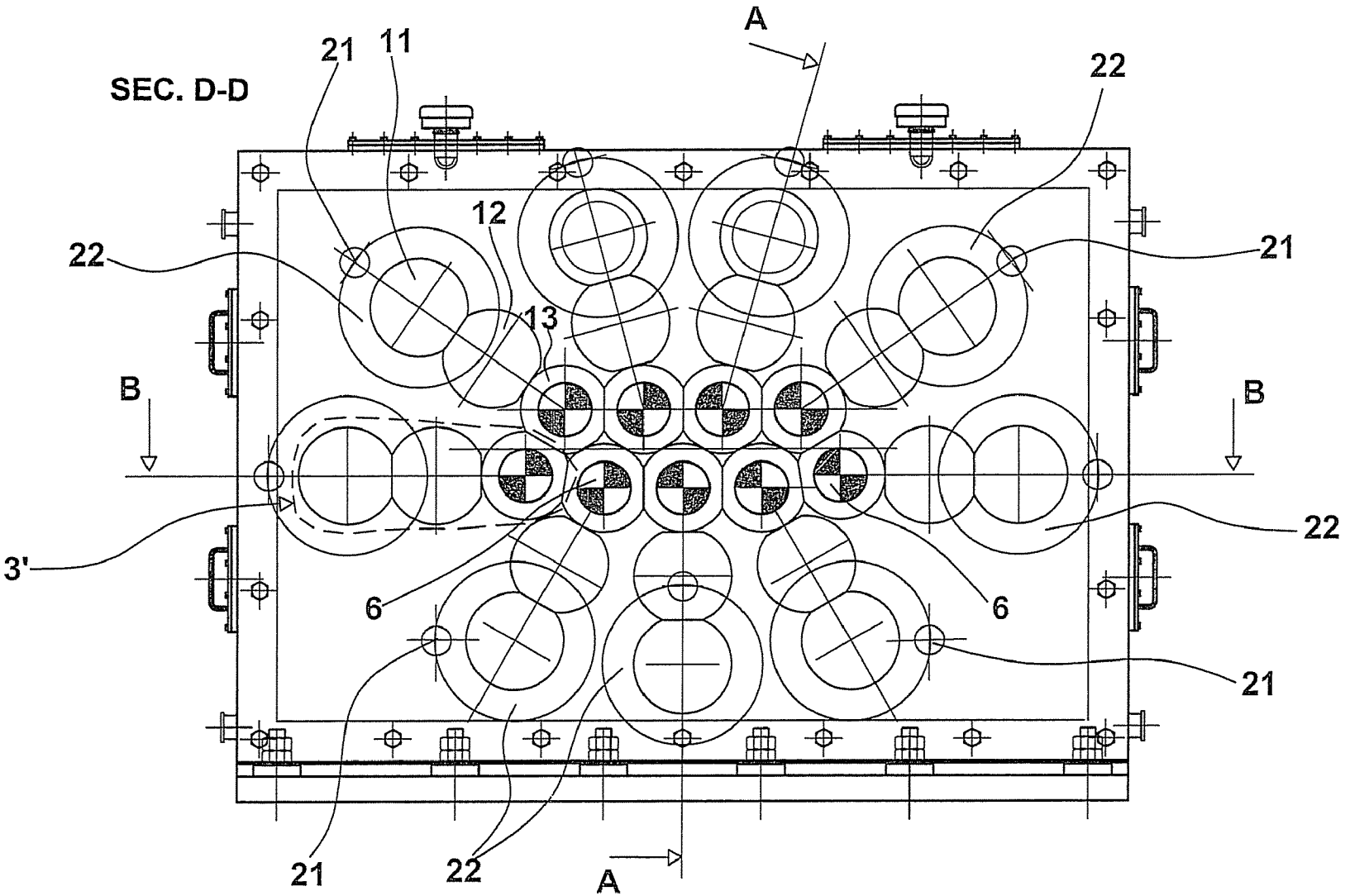
FIG. 3 shows a rear view of the same component as in FIG. 2.
Figure 4:
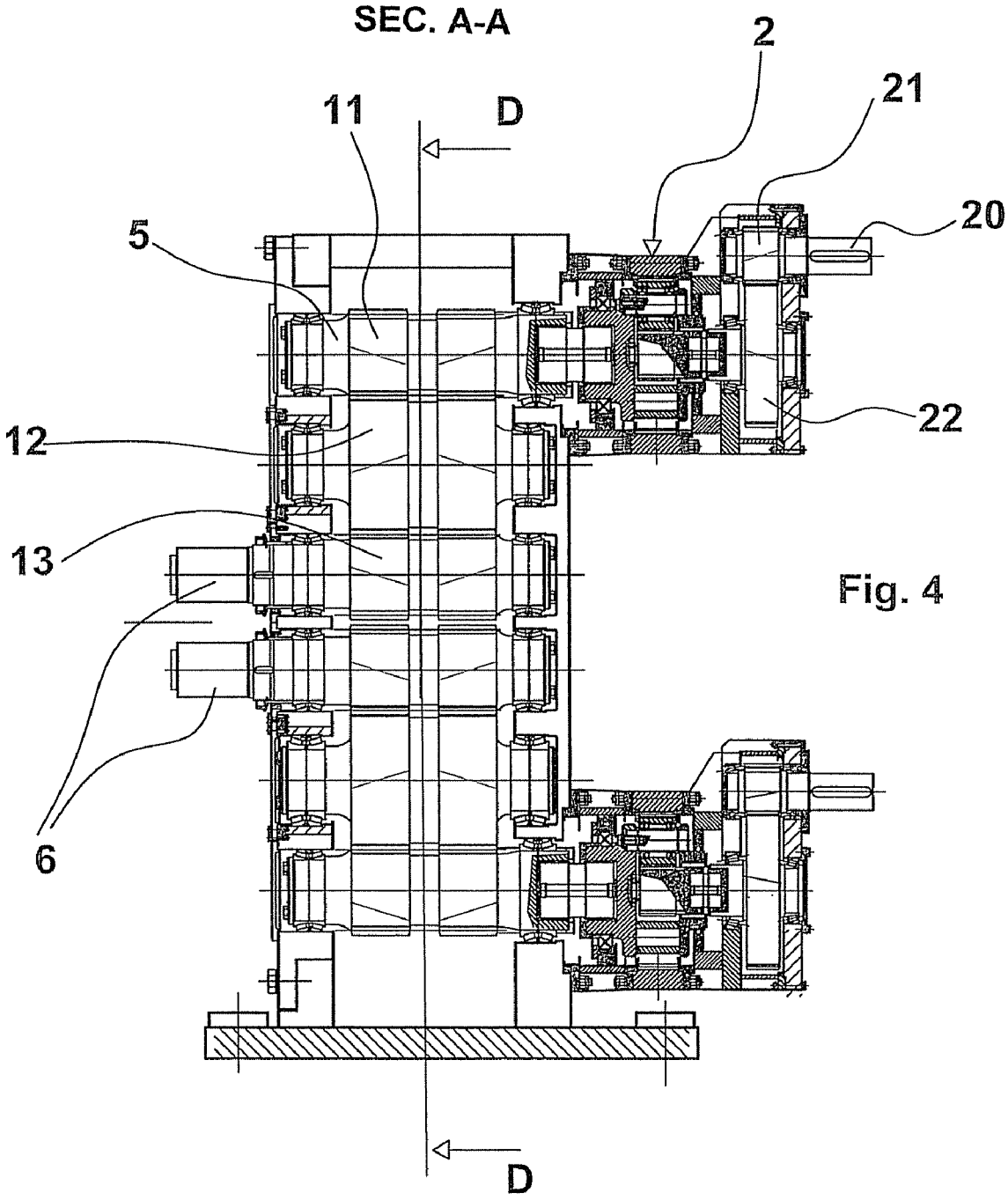
FIG. 4 shows a cross section along the trajectory A-A of the component in FIG. 2.
Figure 5:
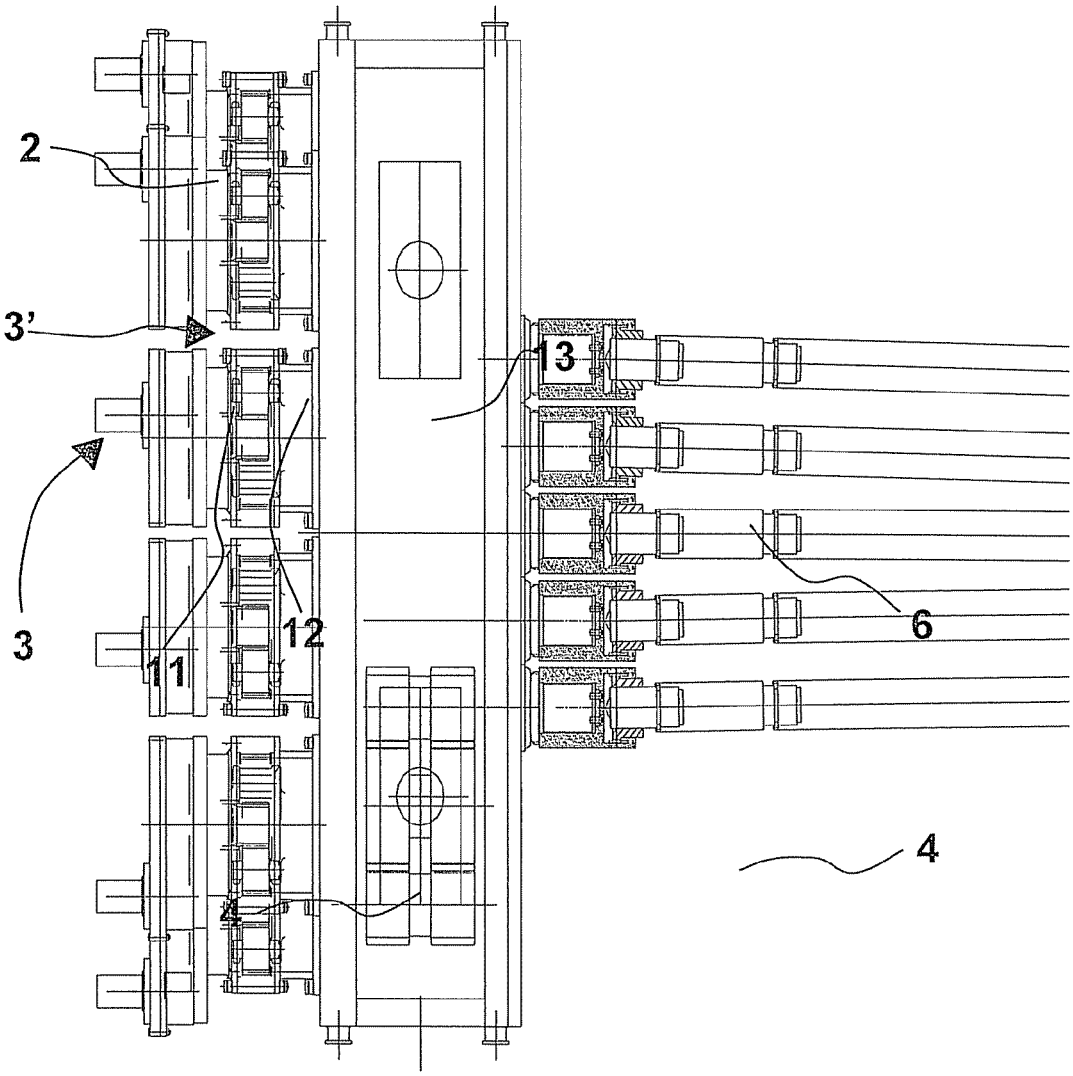
FIG. 5 shows a top view of the component in FIG. 2.
Figure 6:
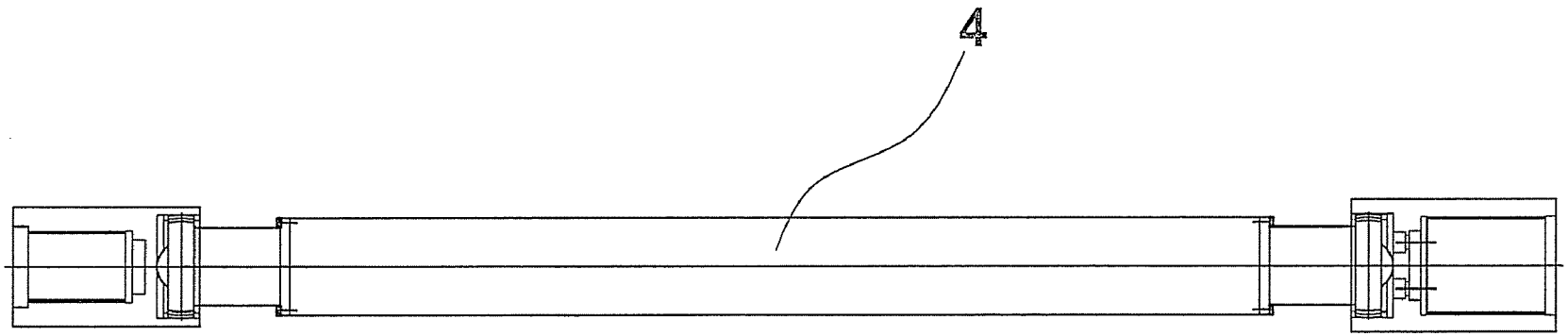
FIG. 6 shows a section of a second component of the device according to the invention.

These gear distributions 3' are not mechanically connected to each other, thereby allowing the independent operation of each flattening roller. Such gear distributions 3' are advantageously arranged in an outer peripheral position relative to the axes of the flattening rollers, according to a finger configuration which determines high compactness, as shown in FIG. 3.

The distributor 3 also includes:

a steel housing, completely embedded in the foundation;

helical teeth for pinions and wheels;

forged steel gears with antifriction bearings.

Finally, the adapters 4 or extensions or toothed driving shafts connect the gear distributor 3 to the flattening rollers 8. These adapters 4 include a splined hub connected to the operating roller. Also, they have operating angles, preferably between 0 and 2°.

Another advantage of the roller actuating device, related to the present invention, includes its high compactness. In particular, the maximum overall dimensions of the zone comprising the drive mechanisms from the motors 1 to the toothed adapters 4 do not exceed 3000×2200×1900 mm.

In one of its alternative embodiments, the actuating device could control couples, triplets or groups of more than three rollers; each couple, triplet or group is controlled by its own motor.

This roller actuating device, according to the invention, is not limited to flattening machines but it can also be used with any machine used for processing metal products, in particular for any application in which the pitch between the driven rollers is so reduced that it may affect the use of articulated transmission members.

The invention claimed is:

1. Actuating device for actuating rollers of metal products processing machines, comprising rollers able to rotate, the rollers defining respective axes of rotation, the actuating device comprising motor means for transmitting rotation to said rollers, transmission means for transmitting motion from said motor means to said rollers, wherein the transmission means include, for each roller, a first pinion reduction gear unit and a sprocket, a second sun-and-planet motion reduction gear unit, a flat gear distribution connecting said second reduction gear unit to a transmission shaft for transmitting rotation to the roller.

2. Device according to claim 1, wherein said second reduction gear unit and said gear distributions are incorporated in a support frame set onto foundations.

3. Device according to claim 2 wherein the motor means are placed on one side with respect to said frame.

4. Device according to claim 3 wherein said gear distributions are arranged in an outer peripheral position relative to the axes of the rollers.

5. Device according to claim 4 wherein said gear distributions comprise a first pinion connected to a sun-and-planet motion, an idle wheel and a second pinion connected to a transmission shaft.

6. Device according to claim 5 wherein the transmission shafts are toothed adapters.

7. Device according to claim 6, wherein the operating angles of said toothed adapters are preferably between 0 and 2°.

* * * * *